US006195004B1

(12) United States Patent
Leonowich

(10) Patent No.: US 6,195,004 B1
(45) Date of Patent: Feb. 27, 2001

(54) DISTRIBUTED EARCON LOCAL AREA NETWORK

(75) Inventor: Robert Henry Leonowich, Temple, PA (US)

(73) Assignee: Lucent Technologies, Inc., Murray Hill, NJ (US)

( * ) Notice: Subject to any disclaimer, the term of this patent is extended or adjusted under 35 U.S.C. 154(b) by 0 days.

(21) Appl. No.: 09/312,815

(22) Filed: May 14, 1999

(51) Int. Cl.[7] ..... G08B 1/08

(52) U.S. Cl. ..... 340/539; 340/692; 340/825.19; 340/286.02

(58) Field of Search ..... 340/692, 286.02, 340/286.13, 825.06, 506, 531, 539, 825.19

(56) References Cited

U.S. PATENT DOCUMENTS

| | | | | |
|---|---|---|---|---|
| 4,673,920 | * | 6/1987 | Ferguson et al. | 340/521 |
| 5,293,385 | | 3/1994 | Hary | 371/19 |
| 5,351,272 | | 9/1994 | Anraham | 375/38 |
| 5,638,047 | * | 6/1997 | Orloff et al. | 340/539 |
| 5,815,086 | | 9/1998 | Ivie et al. | 340/825.52 |
| 5,826,064 | | 10/1998 | Loring et al. | 395/500 |

OTHER PUBLICATIONS

Home Director—The Intelligent Home Powered by IBM<http://www.pc.ibm.com/us/homedirector/wihd.html>.

James Gleick, Fast Forward—What the Beep is Going On?, N. Y. TIMES, Aug. 16, 1998 <http://search.nytimes.com/search/daily/bin/fastwed?getdoc+site+site+62248+0+wAAA+ear>.

IBM and Bell Atlantic Team Up to Deliver Home Networking Solutions to Consumers, Business Wire, Feb. 2, 1999.

* cited by examiner

*Primary Examiner*—Daryl Pope

(74) *Attorney, Agent, or Firm*—Synnestvedt & Lechner LLP

(57) ABSTRACT

A method and apparatus for alerting an individual that an appliance has completed a specified event. This invention consists of assigning distinct audio signals to events performed by an appliance and distributing the distinct audio signals throughout a local area network upon the occurrence of an event. Each device would then selectively emit the distinct audio signal received. The devices may communicate which each other over conventional connections such as a home's existing electrical system, radio frequencies, intra red light, local area network wiring, or any combination of connections. The invention may incorporate the use of a device that is specifically placed or carried by a user resulting in the user being informed of all events occurring within the network. The transmission of the signal may be directly from device to device or may incorporate a distribution device to monitor events and control which devices emit the signal. The distribution device may also redirect the signal from one communication medium to another, such as from radio frequencies to a home's existing electrical wiring.

28 Claims, 3 Drawing Sheets

DISTRIBUTED EARCON LOCAL AREA NETWORK

FIELD OF THE INVENTION

This invention relates to networking of household appliances and the like.

BACKGROUND OF THE INVENTION

Presently, as shown in FIG. 1, households may contain many different electrical appliances including, but not limited to, televisions, fire alarms, computers, telephones, microwaves, washing machines and dryers. Commonly, these appliances are distinct entities that operate without any communication with each other.

Companies are currently developing home local area networks ("home LANs") which are designed to allow control of electrical devices connected to the network through a personal computer or some other type of microcontroller with an input device for interfacing with the network, such as a touch-pad. An example of current home LAN technology is IBM's Home Director System. These systems are directed at controlling and monitoring appliances from central locations, and are limited to visual feedback through a computer monitor or LCD display.

Other companies are working on developing earcons. Earcons are icons for the ear. An earcon is a distinct audio signal which corresponds to the occurrence of a specific event. For example, after finishing a wash cycle, a washing machine emits a distinctive sound that would conjure up the image of a washing machine in the mind of a user and a microwave would emit a similarly distinct sound after finishing a cooking cycle. Audio signals have the advantage of being emitted and perceived from any direction, allowing an operator to focus on other tasks and only shift attention when the appropriate signal is perceived. The same benefit cannot be obtained in a visual indicator environment because an operator has to repeatedly focus attention on a device to look for an indication of a completed task. Also, visual indicators are rendered useless once the operator leaves the room containing the indicator.

Another benefit of assigning distinct audio signals to different devices is that it eliminates confusion when the operator of the device has multiple devices running at the same time or is in a different room than the device that is signaling. However, in order for the devices to be heard in different rooms or even on different floors of a home, it is necessary for an audio signal emitted from a device to be sufficiently loud so that it may be perceived when an individual is remote to the device, or there is a competing level of noise in the environment such as a vacuum cleaner. The required decibel level for an audio indicator to be heard throughout a wide area could be impractical or even dangerous.

SUMMARY OF THE INVENTION

The present invention proposes a novel method and apparatus for alerting an individual that a device has performed a designated event. The present invention alerts individuals by assigning distinct audio sounds to represent events executed by a device and distributing the distinct audio signals throughout a local area network to select devices. By distributing the distinct audio signals to select devices connected to the local area network, each selected device can simultaneously emit the same audio signal, whereby the decibel level of the emitted audio signals can be reduced while still providing more comprehensive coverage throughout the environment.

DETAILED DESCRIPTION OF THE INVENTION

The present invention provides improved convenience and safety by interconnecting devices having distinct audio signals to form a network. Within the network, each task that a device performs, for which monitoring is desired, is assigned a distinct audio signal which is generated upon the occurrence of a specified event. Upon the occurrence of a specified event, the generated signal is emitted from other devices on the network.

Figure 2:
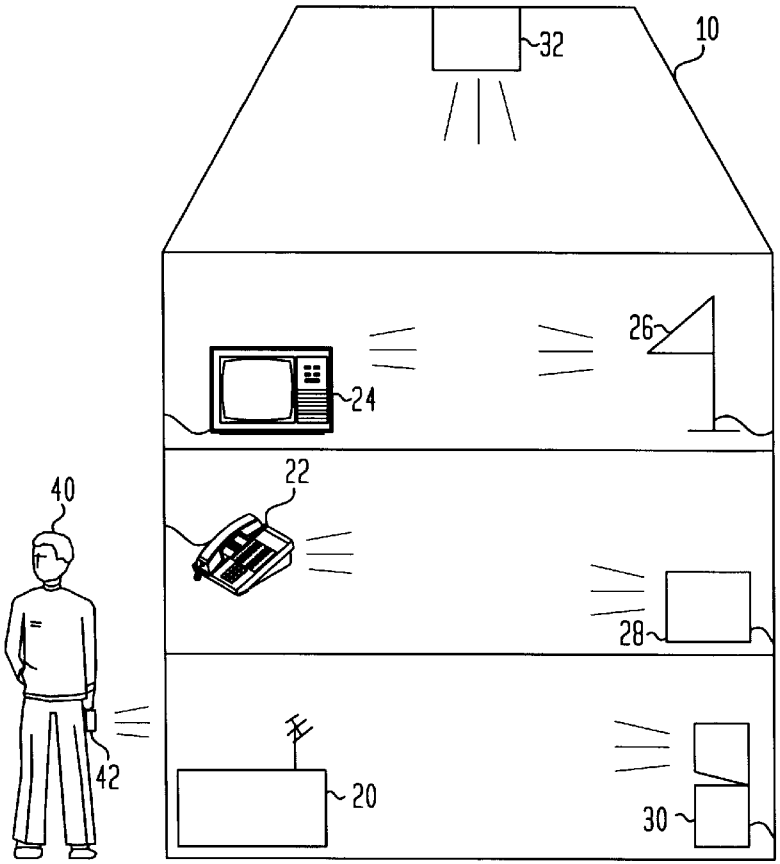
FIG. 2 is a diagram of a home containing electrical devices in accordance with the present invention.
Figure 1:
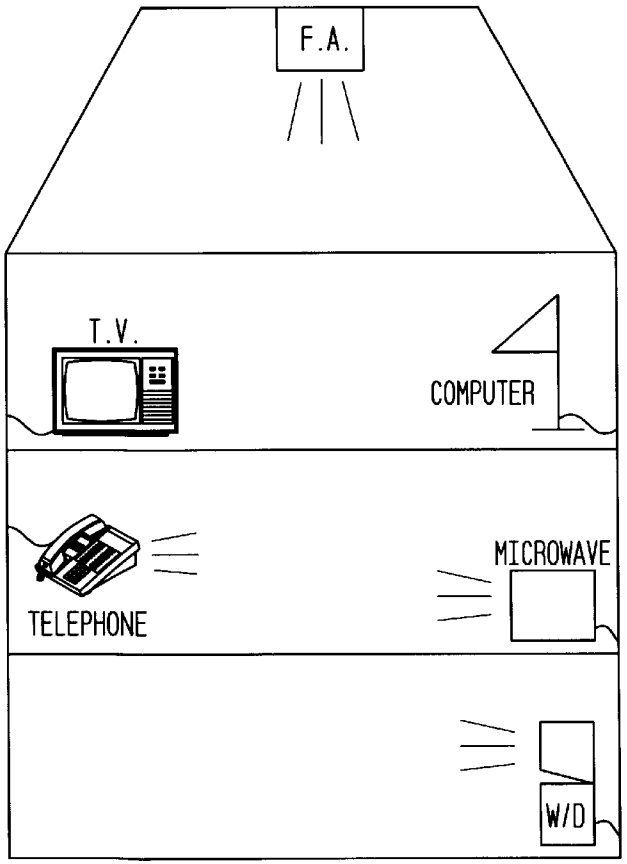
FIG. 1 (PRIOR ART)
FIG. 1 is a diagram of a prior art home containing electrical devices.

Referring more specifically to the drawings, FIG. 2 depicts a preferred embodiment of the present invention. Home 10, contains telephone 22, television 24, computer 26, microwave 28, washer/dryer 30, and fire alarm 32. The items depicted in home 10 are representative of the types of devices that may be found in a traditional home, however, the type and number of devices are for illustrative purposes only and are neither required nor restrictive. Table 1 shows examples of distinct signals that may be assigned to specific events that devices perform.

TABLE 1

| Device | Event | Signal |
|---|---|---|
| Telephone 22 | Incoming Call | Signal 1 |
| Television 24 | Cable Disconnect | Signal 2 |
| Computer 26 | Printing Complete | Signal 3 |
| | E-Mail Received | Signal 4 |
| Microwave 28 | Food Ready | Signal 5 |
| Washer/Dryer 30 | Cycle Complete | Signal 6 |
| Fire Alarm 32 | Fire | Signal 7 |

When a device performs an event, that device generates a signal which is unique to that device. For example, if fire alarm 32 detects a fire, fire alarm 32 generates signal 7. Signal 7 is a signal that represents that fire alarm 32 has detected a fire and is emitted by fire alarm 32. An electrical representation of signal 7 is also transmitted to telephone 22, television 24, computer 26, microwave 28 and washer/dryer 30 where each device interprets the electrical signal and emits a representation of signal 7, indicating that fire alarm 32 detected a fire. The audio signal emitted from each device may or may not be identical at each device on the network for a given event. For example, computer 26 may emit a certain audio signal to indicate that printing is complete in response to signal 3 and a different audio signal to indicate that an e-mail has been received in response to signal 4, however, television 24 and microwave 28 may emit an audio signal which is a generic representation of a computer 26 in response to either signal 3 or signal 4. Alternatively, all devices may emit the same audio signal in response to a signal representing a given event.

The generated electrical and audio signals can be transmitted and emitted via any practical means. Presently, there are devices which allow information to be sent over electrical lines. For example, there are intercoms and speaker systems which plug into electrical outlets and transfer information over conventional wiring to any other outlet within the same building. The electrical signals may also be transmitted and received via radio frequencies or infra red light, or a combination of different methods. The audio signals may be emitted via speakers, bells, buzzers, whistles, or chimes. For illustrative purposes only, an exemplary system is discussed below using radio frequency signals for transmitting signals between devices and using speakers to emit the signals at the designated devices. Many other manners of transmitting signals amongst the various devices and emitting the signals at the various devices are well known in the prior art.

Figure 3:
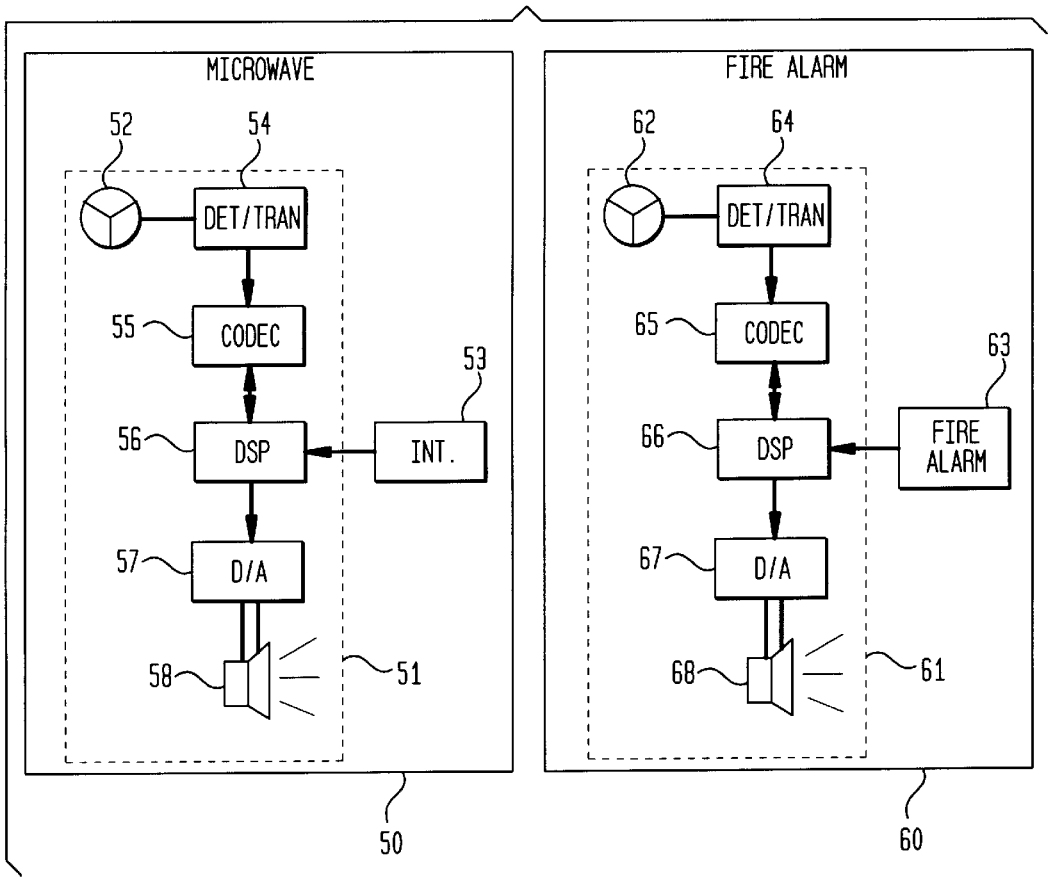
FIG. 3 is a block diagram of communication circuitry in accordance with the present invention.

FIG. 3 depicts one embodiment of the invention. In FIG. 3, microwave 50 and fire alarm 60 contain networking circuits 51 and 61, respectively. Networking circuit 51 contains an antenna 52, detector/transmitter 54, CODEC 55, DSP 56, digital-to-analog converter 57, and speaker 58. Similarly, networking circuit 61 contains an antenna 62, detector/transmitter 64, CODEC 65, DSP 66, digital-to-analog converter 67, and speaker 68. In the event of a fire, DSP 66 receives a signal from fire detector 63. DSP 66 outputs a signal which is emitted from fire alarm 60 through speaker 68 after digital to analog conversion by digital-to-analog converter 67.

In addition, DSP 66 also generates a signal for transmission to other devices such as microwave 50. The digital signal out of DSP 66 is converted to analog by CODEC 65. After conversion to analog, the analog signal enters detector/transmitter 64 and is sent out of fire alarm 60 via antennae 62. The transmitted signal then enters microwave 50 via antennae 52 where it is detected by detector/transmitter 54. The detected signal is then converted to digital by CODEC 55 and interpreted by DSP 56. DSP 56 then sends a signal to be emitted by microwave 50 through speaker 58 after digital to analog conversion by digital-to-analog converter 57. The signal transmission and audio emission described above would be equally applicable to a signal originated by microwave interface circuit 53, and emitted by microwave 50 and fire alarm 60.

In another embodiment of the invention, DSP 56 and DSP 66 perform the additional function of determining if a received signal should be emitted. For example, it may be desirable to have telephone 22 in the bedroom ignore signal 5 from microwave 28 in the kitchen. However, signal 7 from fire alarm 32 should be emitted from every device. This could be accomplished by assigning different status levels to emitted signals. For example, signal 7 from fire alarm 32 could emit a status 1 signal which would be emitted from every device on the network. Other devices could be assigned different status levels and a threshold status level that would have to be met in order for another device's signal to be transmitted from that device. The DSP in each device could readily be programmed to implement such a scheme. Alternatively, the DSP of each device could be individually programmed to set which audio signals the corresponding device will emit and which it will not.

Figure 4:
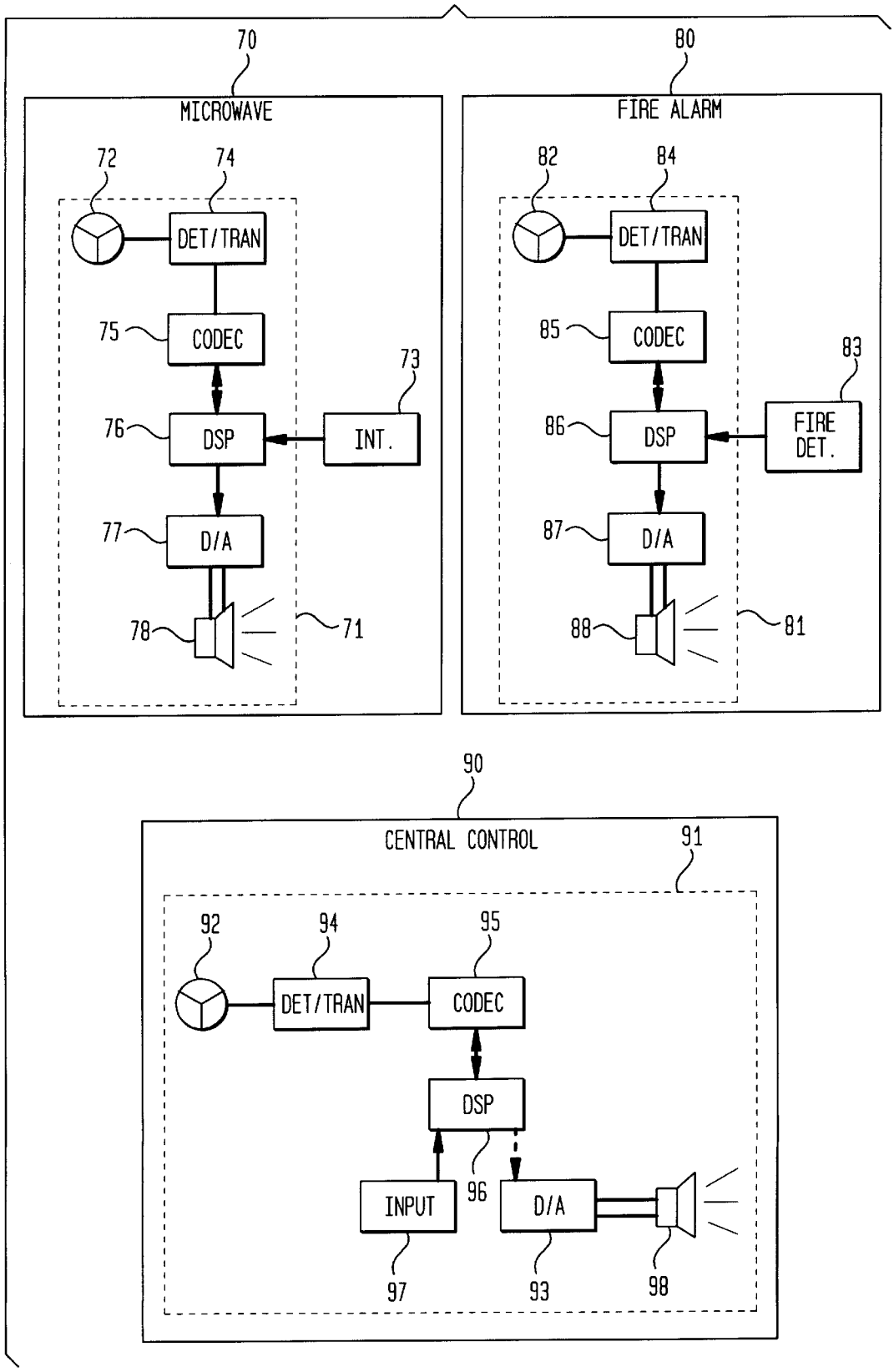
FIG. 4 is a block diagram of alternative communication circuitry in accordance with the present invention.

In another embodiment of the invention, illustrated in FIG. 4, a central control box 90 is utilized as a means for receiving and distributing signals throughout the network. The central control box 90 is designed to receive signals from each device within the network and distribute the signal to select devices on the network.

In FIG. 4, microwave 70 and fire alarm 80 contain networking circuits 71 and 81, respectively. Networking circuit 71 contains an antenna 72, detector/transmitter 74, CODEC 75, DSP 76, digital-to-analog converter 77, and speaker 78. Similarly, networking circuit 81 contains an antenna 82, detector/transmitter 84, CODEC 85, DSP 86, digital-to-analog converter 87, and speaker 88. In the event of a fire, DSP 86 receives a signal from fire detector 83. DSP 86 then outputs a signal which is emitted from fire alarm 80 through speaker 88 after digital to analog conversion by digital-to-analog converter 87.

In addition, DSP 86 also generates a signal for transmission to central control box 90. The digital signal out of DSP 86 is converted to analog by CODEC 85. After conversion to analog, the analog signal enters detector/transmitter 84 and is sent out of fire alarm 80 via antennae 82.

The transmitted signal then enters central control box 90 via antennae 92 where it is detected by detector/transmitter 94. The signal is then converted to digital by CODEC 95 to prepare the signal for processing by DSP 96. DSP 96 processes the signal using predefined instructions which can be updated by a user through input device 97. The DSP 96 can transmit the signal to all devices on the network or act as a signal clearing house which determines which signals should be emitted by which devices. Optionally, central control box 90 may contain digital-to-analog converter 93 and speaker 98 for emitting an audio signal at the central control box 90. Due to the flexibility obtained from using DSP 96, the manner in which the emission of certain signals from certain devices is controlled can be performed in many different ways. For example, each device on the network could be assigned a unique address. DSP 96 could then instruct which devices should emit the signal by attaching the unique addresses to the signal, where the DSPs of the different devices interpret the signal and only emit the signal if their unique address is attached. DSP 96 could readily be programmed to implement such a scheme.

The processed signal is then converted back to analog by CODEC 95 and transmitted by detector/transmitter 94 via antennae 92. The signal transmitted by central control box 90 enters microwave 70 via antennae 72 where it will be detected by detector/transmitter 74. The detected signal will then be converted to digital by CODEC 75 and interpreted by DSP 76. DSP 76 will then send a signal to be emitted from microwave 70 by speaker 78, after digital to analog conversion by digital-to-analog converter 77. The signal transmission and emission described above would be equally applicable to a signal originated by microwave interface 73, and emitted by microwave 70, fire alarm 80, and optionally central control box 90.

Central control box 90 may contain different methods of receiving and transmitting the signals, such as A/C wiring, radio frequency, infra red light, telephone lines, and/or local area network lines. By utilizing multiple receiving and transmitting mediums, and directing transmit signals to the appropriate mediums, increased system flexibility is achieved. For example referring back to FIG. 2, portable device 42 is capable of communicating with central control box 20 via radio frequencies. Portable unit 42 is carried or placed in a desirable location for the convenience of user 40, allowing user 40 to monitor all events occurring on the network as long as unit 42 is within communication distance of central control box 20. Additionally, a radio frequency signal from fire alarm 32 could be emitted from a device connected to central control box 20 solely though a home's existing AC wiring such as washer/dryer 30.

The use of different means of transmitting and receiving signals results in different components for circuits 51, 61, 71, 81 and 91. For example, if the devices in FIG. 3 were connected via a hard wired local area network, the signals could be sent digitally from DSP 66 to DSP 56. Thus, antennae 52 and 62, detector/transmitter 54 and 64, and CODEC 55 and 65 would no longer be needed. Similar modifications are readily apparent depending on the manner of transmission desired.

Figure 5:
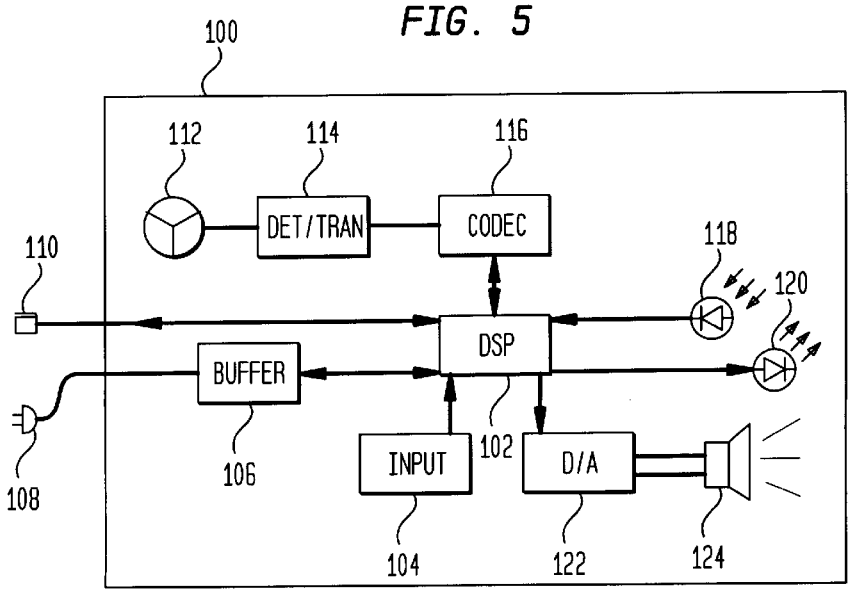
FIG. 5 is a block diagram of a central control box in accordance with the present invention.

FIG. 5 illustrates the many different communication mediums available for use by central control box 100. Central control box 100 contains a DSP 102 which interfaces with the home environment through input device 104, AC wiring connection 108, LAN connection 110, antenna 112, photo-detector 118, photo-transmitter 120, and speaker 124. The DSP 102 may also contain appropriate circuitry for conditioning signals for use in a variety of mediums such as buffer 106, detector/transmitter 114, CODEC 116, and digital-to-analog converter 122. The precise details for generating and receiving signals in the variety of mediums are well known within the art. The DSP 102 of central control box 100 allows signals to be manipulated such that a signal can be received in one medium and transmitted in one or more selected mediums. For example, central control box 100 could receive a signal from a fire alarm through antennae 112 and send a signal to a microwave through AC wiring connection 108 and to a computer through LAN connection 110. The types of mediums shown in FIG. 5 are for illustrative purposes only. The mediums used to practice the invention can be through any medium which may include additional methods of communication or may utilize fewer methods of communication.

Having thus described a few particular embodiments of the invention, various alterations, modifications, and improvements will readily occur to those skilled in the art. Such alterations, modifications and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

What is claimed is:

1. An apparatus for emitting an audio signal to indicate that an event associated with a device has occurred, comprising:

a first device having a first circuit for generating a first electrical signal upon the occurrence of a first specified event associated with said first device, a first circuit for emitting a first distinct audio signal responsive to said first electrical signal, and a first circuit for transmitting said first electrical signal;

a second device having a first circuit for receiving said first electrical signal and a second circuit for emitting a second distinct audio signal responsive to receipt of said first electrical signal, wherein said second device emits said second distinct audio signal upon occurrence of said first specified event.

2. The apparatus of claim 1, wherein said first device and said second device are appliances.

3. The apparatus of claim 2, wherein said first device and said second device comprise a local area network.

4. The apparatus of claim 1, wherein said second device further comprises a second circuit for generating a second electrical signal upon the occurrence of a second specified event associated with said second device, wherein said second circuit for emitting also emits a third distinct audio signal responsive to said second electrical signal, and a second circuit for transmitting said second electrical signal; and said first device further comprises a second circuit for receiving said second electrical signal, wherein said first circuit for emitting emits a fourth distinct audio signal responsive to receipt of said second electrical signal.

5. The apparatus of claim 4, wherein said first and second circuits for transmitting and said first and second circuits for receiving communicate over a medium selected from a group consisting of radio frequency, electrical wiring within a home, infra red light, telephone wiring, and local area network wiring.

6. The apparatus of claim 4, wherein said first circuit for emitting and said second circuit for emitting comprise a component selected from a group consisting of speakers, buzzers, chimes, bells, and whistles.

7. The apparatus of claim 4, wherein said first and second distinct audio signals are the same, and said third and fourth distinct audio signals are the same.

8. The apparatus of claims 1, wherein said second device further comprises:

a circuit for determining if said first distinct electrical signal meets a predefined criteria and inhibiting said second device from emitting said second distinct audio signal upon occurrence of said first specified event if said first distinct electrical signal does not meet said predefined criteria.

9. The apparatus of claim 1, wherein said second device is a remote unit which can be optimally placed by said user.

10. The apparatus of claim 1, wherein said first circuit for generating comprises a digital signal processor.

11. The apparatus of claim 1, further comprising:

a central control box which receives said first distinct electrical signal from said first device and transmits said first distinct electrical signal to said second device.

12. A method for emitting an audio signal to indicate that an event associated with a device has occurred, comprising the steps of:

generating at a first device a first electrical signal upon the occurrence of a first specified event associated with said first device;

emitting a first distinct audio signal at said first device responsive to generation of said first electrical signal;

transmitting said first electrical signal;

receiving said first electrical signal at a second device; and emitting a second distinct audio signal at said second device responsive to receipt of said first electrical signal;

wherein said second device emits said second distinct audio signal upon occurrence of said first specified event.

13. The method of claim 12, wherein said first device and said second device are household appliances.

14. The method of claim 13, wherein said first device and said second device comprise a local area network.

15. The method of claim 12, wherein said second device is a remote unit which can be optimally placed by said user.

16. The method of claim 12, further comprising the steps of:

generating at said second device a second electrical signal upon the occurrence of a second specified event associated with said second device;

transmitting said second electrical signal;

receiving said second electrical signal at said first device;

emitting a third distinct audio signal at said first device; and emitting a fourth distinct audio signal at said second device;

wherein said first device emits said fourth distinct audio signal upon occurrence of said second specified event.

17. The method of claim 16, wherein said first and second distinct audio signals are the same, and said third and fourth distinct audio signals are the same.

18. The method of claim 16, wherein said transmitting and receiving steps are conducted via a medium selected from a group consisting of radio frequency, electrical wiring within a home, infra red light, telephone wiring, and local area network wiring.

19. The method of claim 12, further comprising the step of:

relaying said first distinct electrical signal with a central control box, wherein said central control box can receive and transmit electrical signals through different mediums.

20. A local area network comprising;

a first device having a first unique address, a first unique audio signal, and means for communicating a signal corresponding to said first unique audio signal;

a second device having a second unique address, a second unique audio signal, and means for communicating a signal corresponding to said second unique audio signal;

a central control box for communicating with said first device and said second device; wherein upon the reception of said signal corresponding to said first unique audio signal by said central control box, said central control box transmits said signal corresponding to said first unique audio signal to said second device.

21. The local area network of claim 20, wherein upon the reception of said signal corresponding to said second unique audio signal by said central control box, said central control box transmits said signal corresponding to said second unique audio signal to said first device.

22. The local area network of claim 20 or claim 21: wherein said central control box is capable of receiving signals over at least one medium selected from a group consisting of radio frequency, electrical wiring within a home, infra red light, telephone wiring, and local area network wiring; and transmitting signals over at least one medium selected from a group consisting of radio frequency, electrical wiring within a home, infra red light, telephone wiring, and local area network wiring.

23. The local area network of claim 20 or claim 21: wherein said central control box is capable of receiving signals over more than one medium selected from a group consisting of radio frequency, electrical wiring within a home, infra red light, telephone wiring, and local area network wiring; and transmitting signals over more than one medium selected from a group consisting of radio frequency, electrical wiring within a home, infra red light, telephone wiring, and local area network wiring.

24. A local area network, comprising;

a first device having a first unique address, a first unique audio signal, and means for communicating a signal corresponding to said first unique audio signal;

a second device having a second unique address, a second unique audio signal, and means for communication a signal corresponding to said second unique audio signal;

a central control box for communicating with said first device and said second device; wherein upon the reception of said signal corresponding to said first unique audio signal by said central control box, said central control box interprets said signal corresponding to said first unique audio signal and determines whether to transmit said signal corresponding to said first unique audio signal to said second device.

25. The method of claim 24, wherein upon the reception of said signal corresponding to said second unique audio signal by said central control box, said central control box interprets said signal corresponding to said second unique audio signal and determines whether to transmit said signal corresponding to said second unique audio signal to said first device.

26. The local area network of claim 24 or claim 25: wherein said central control box is capable of receiving signals over at least one medium selected from a group consisting of radio frequency, electrical wiring within a home, infra red light, telephone wiring, and local area network wiring; and transmitting signals over at least one medium selected from a group consisting of radio frequency, electrical wiring within a home, infra red light, telephone wiring, and local area network wiring.

27. The local area network of claim 24 or claim 25: wherein said central control box is capable of receiving signals over more than one medium selected from a group consisting of radio frequency, electrical wiring within a home, infra red light, telephone wiring, and local area network wiring; and transmitting signals over more than one medium selected from a group consisting of radio frequency, electrical wiring within a home, infra red light, telephone wiring, and local area network wiring.

28. A device comprising:

a first circuit of a first device adapted to produce a first electrical signal corresponding to a first event of said first device;

a second circuit of said first device adapted to transmit said first electrical signal;

a third circuit of said first device adapted to receive a second electrical signal corresponding to a second event of a second device; and a fourth circuit of said first device adapted to emit a first audio signal responsive to said first electrical signal, and to emit a second audio signal responsive to said second electrical signal, wherein said first device emits said first audio signal upon occurrence of said first event and emits said second audio signal upon occurrence of said second event.

* * * * *